United States Patent [19]

Kudo et al.

[11] 4,281,622

[45] Aug. 4, 1981

[54] APPARATUS FOR DEVELOPING ELECTROSTATIC LATENT IMAGE

[75] Inventors: Yoshio Kudo; Masakazu Iwasa; Hisashi Kato, all of Tokyo, Japan

[73] Assignee: Fuji Photo Film Co., Ltd., Minamiashigara, Japan

[21] Appl. No.: 132,976

[22] Filed: Mar. 24, 1980

Related U.S. Application Data

[63] Continuation of Ser. No. 886,449, Mar. 14, 1978, abandoned.

[30] Foreign Application Priority Data

Mar. 14, 1977 [JP] Japan ..... 52/27759

[51] Int. Cl.[3] ..... G03G 15/08

[52] U.S. Cl. ..... 118/653; 118/103; 118/652; 118/661

[58] Field of Search ..... 118/103, 652, 653, 661

[56] References Cited

U.S. PATENT DOCUMENTS

| | | | |
|---|---|---|---|
| 3,247,007 | 4/1966 | Oliphant | 118/653 X |
| 4,100,884 | 7/1978 | Mochizuki et al. | 118/653 |

*Primary Examiner*—Bernard D. Pianalto

[57] ABSTRACT

In an electrostatic apparatus including a developing roller for applying a toner to an electrostatic latent image carrying drum, a squeeze roller is provided in the vicinity of the developing roller. The squeeze roller is applied with a voltage to attract a part of the toner layer on the developing roller and reduce the thickness of the toner layer.

3 Claims, 3 Drawing Figures

APPARATUS FOR DEVELOPING ELECTROSTATIC LATENT IMAGE

This is a continuation, of application Ser. No. 886,449, filed Mar. 14, 1978, abandoned.

BACKGROUND OF THE INVENTION

1. Field of the Invention

This invention relates to an apparatus for developing an electrostatic latent image, and more particularly to an apparatus for developing an electrostatic latent image into a toner image in which the thickness of a toner layer which is used for forming the toner image is controlled to control the density of the toner image.

2. Description of the Prior Art

In a touch down development of a donor development method of electrostatography in which an electrostatic latent image is developed into a toner image and the toner image is transferred to paper or the like or is used as a final image, the image density changes with the thickness of a toner layer which is used for forming the toner image. The thickness of the toner layer is controlled, for instance, by use of a doctor blade projection toward a developing roller. A part of the toner layer is scraped off by the edge of the doctor blade to obtain a desirable thickness of the toner layer.

The inventors of this invention have proposed an electrostatic print marking apparatus in which steel plates are printed with markings which, for example, indicate the dimensions of the steel plate, the date of manufacturing of the steel plate and other pertinent information immediately after the steel plates have been fed out of a rolling mill. In the print marking apparatus, the traveling speed of the steel plates fed out of the rolling mill is measured and the marking apparatus is driven in synchronization with the speed of the steel plates. The speed of the steel plates fed from the rolling mill is not constant, but depends on the condition of the rolling operation. Therefore, the speed of rotation of the developing roller and an electrostatic recording drum is changed according to the speed of the steel plates, which results in a change in the length of the development time and accordingly a change in image density of the toner image obtained.

In an electrostatic apparatus, it is always desirable that the toner image be developed in a constant density. Though it is possible to control the image density of the toner image by controlling the thickness of the toner layer by use of a doctor blade, in actual practice, the adjustment of the doctor blade proves to be difficult and requires a complex control system.

SUMMARY OF THE INVENTION

The primary object of the present invention is to provide a developing apparatus which is capable of controlling the image density of the toner image by a simple mechanical means.

Another object of the present invention is to provide a developing apparatus which is capable of preventing formation of fog in the toner image.

The above objects are accomplished by providing an image density control roller in the vicinity of the developing roller in an electrostatic developing apparatus. The image density control roller, hereinafter referred to as a "squeeze roller", is applied with a voltage the level of which controls the image density of the toner image. By the electrostatic force effected by the squeeze roller applied with a voltage, a part of the toner layer on the developing roller is transferred to the squeeze roller, whereby the thickness of the toner layer on the developing roller is controlled by the level of the voltage applied.

Further, the toner image includes excessive toner existing in the non-image areas, which is called fog. The fog is caused by the toner particles in the toner layer having an extraordinarily large diameter or having an extraordinarily high charge density. The excessive toner which would otherwise cause the fog can be removed by the squeeze roller employed in the present invention.

DESCRIPTION OF THE PREFERRED EMBODIMENT

Figure 1:
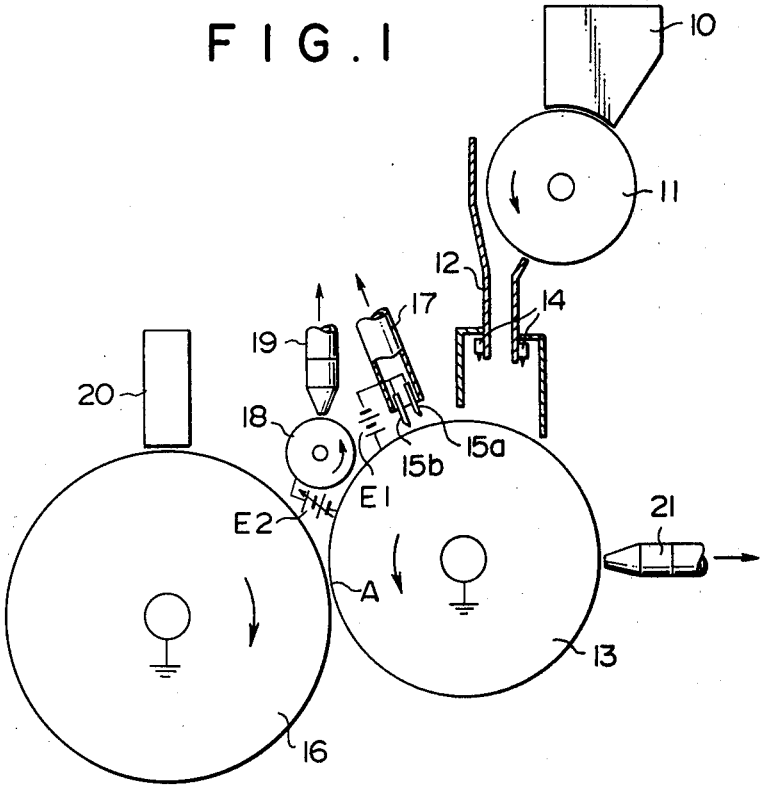
FIG. 1 is a side view partly in section of an embodiment of the developing apparatus in accordance with this invention.

Referring to FIG. 1, a hopper 10 contains therein a developer, i.e. a toner, to be applied on a developing roller 13 by way of a toner feed roller 11 and a guide duct 12. The hopper 10 has an open lower end past which the toner feed roller 11 rotates to take out toner at a predetermined rate. The toner feed roller 11 has on its periphery a number of fine grooves to effectively take out and carry the toner thereon.

The toner taken out of the hopper 10 by the toner feed roller 11 is scattered on a developing roller 13 by way of the guide duct 12. The guide duct 12 is provided with a pair of electrodes 14 for charging the toner passing therethrough with negative polarity.

The developing roller 13 shown in FIG. 1 is a metal roller, but a metal belt can also be used. The toner scattered on the developing roller 13 accumulates thereon as a toner layer. The toner layer is first roughly scraped off by a pre-doctor blade 15*a* and is then finely scraped off by a main doctor blade 15*b*. By these two doctor blades 15*a* and 15*b*, the thickness of the toner layer is controlled to obtain a toner image of desirable image density. The thickness of the toner layer is controlled to be equal to the space between the developing roller 13 and an electrostatic latent image carrying drum 16 or to be about 20$\mu$ smaller than the space.

A bias voltage is applied between the developing roller 13 and the doctor blades 15*a* and 15*b* by a bias source E1 so as to prevent the toner from sticking to the tip of the doctor blades 15*a* and 15*b*. The tip of the blades are thus charged to the same polarity as that of the toner to create a repulsive force between the tip of the blades and the toner. Further, in order to discharge the toner scraped off by the doctor blades 15*a* and 15*b*, the doctor blades 15*a* and 15*b* are provided in a suction hood 17.

Behind, namely downstream of the doctor blades 15*a* and 15*b*, is provided a rotatable squeeze roller 18 made of metal which is applied with a voltage by a power source E2. The squeeze roller 18 is located a proper distance from the surface of the toner layer on the developing roller 13. By the electrostatic force effected by the squeeze roller 18, a part of the toner of the toner layer on the developing roller 13 is attracted to the squeeze roller 18. The strength of the electrostatic force depends upon the level of the voltage applied to the squeeze roller 18 and the space between the squeeze roller 18 and the surface of the toner layer on the developing roller 13. In order to control the strength of the electrostatic force, both the level of the voltage and the space are made controllable. From the practical viewpoint, since it is difficult to control the position of the squeeze roller 18, the electrostatic force is usually controlled mainly by controlling the level of the voltage applied to the squeeze roller 18. Only when the thickness of the toner layer is greatly changed by the doctor blades 15*a* and 15*b*, is the position of the squeeze roller 18 changed to maintain the proper space between the surface of the squeeze roller 18 and the surface of the toner layer on the developing roller 13.

The level of the voltage applied to the squeeze roller 18 is changed according to the speed of rotation of the developing roller 13. Further, the level of applied voltage is desired to be manually controllable in order to allow fine control of the image density. A suction nozzle 19 is provided in the vicinity of the squeeze roller 18 to recover the toner taken up by the squeeze roller 18. The recovered toner is returned to hopper 10 for reuse by the developing apparatus.

The toner layer formed on the developing roller 13 is transferred to the electrostatic latent image carrying drum 16 at the point A in the drawing for developing the latent image into a toner image on the drum 16. The drum 16 is a metal drum or belt carrying thereon an insulating layer. On the insulating layer an electrostatic latent image is formed by use of a number of discharge electrodes 20 in the form of an array of discharge needles. The excessive toner remaining on the developing roller 13 is recovered by a suction nozzle 21 provided in the vicinity of the developing roller 13.

In operation of the above described developing apparatus in accordance with an embodiment of the present invention, the toner in the hopper 10 is taken out at a predetermined rate by the toner feed roller 11 and is scattered on the developing roller 13 by way of the guide duct 12. In the course of the scattering of the toner through the guide duct 12, the toner is charged with negative polarity by the charging electrodes 14.

Figure 2:
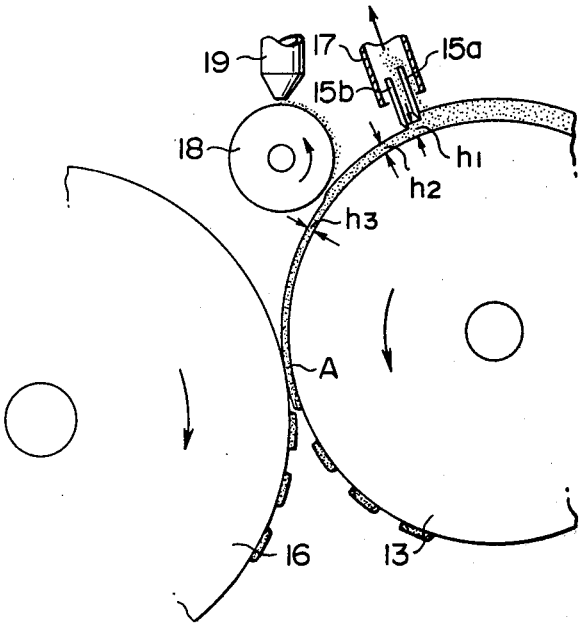
FIG. 2 is an enlarged side view partly in section of the main part of the developing apparatus in accordance with this invention.

As shown in detail in FIG. 2, the relatively thick toner layer initially applied to the developing roller 13 is partly scraped off by the pre-doctor blade 15*a* to a thickness of h1 and then by the main doctor blade 15*b* to a thickness of h2. The difference between the thicknesses h1 and h2 should preferably be 150μ or less so as to obtain a uniform thickness. The toner scraped off by the doctor blades 15*a* and 15*b* is recovered by the suction hood 17.

The thickness h2 is substantially equal to the space between the surfaces of the electrostatic latent image carrying drum 16 and the developing roller 13. The toner layer having a thickness of h2 then comes to face the squeeze roller 18 and a part of the toner layer is attracted to the squeeze roller 18 by an electrostatic force. The toner attracted to the squeeze roller 18 is recovered by the suction nozzle 19. By the squeeze roller 18, the thickness of the toner layer is reduced to h3. Since the squeeze roller 18 does not touch the surface of the toner layer, the effect thereof is a non-contact scraping effect. Further, excessive toner likely to cause fog is removed by the squeeze roller 18. The level of the voltage applied to the squeeze roller 18 is controlled to become higher with decreasing speed of rotation of the developing roller 13. This is because when the speed of rotation of the developing roller 13 is low, the developing time is long. In order to make the thickness of the toner layer smaller to prevent the image density from becoming too high the level of the voltage applied to the squeeze roller 18 must be made high.

When the developing roller 13 is further rotated and the toner layer is brought to the point A, the toner layer comes to face the electrostatic latent image carried by the drum 16 formed by the discharge electrodes 20 and the toner is attracted by the electrostatic latent image to develop the image into a visible toner image. The toner image is directly or indirectly, by way of a transfer belt or the like, transferred to a recording medium such as a paper or a steel plate. The excessive toner remaining on the developing roller 13 is recovered by the suction nozzle 21.

Figure 3:
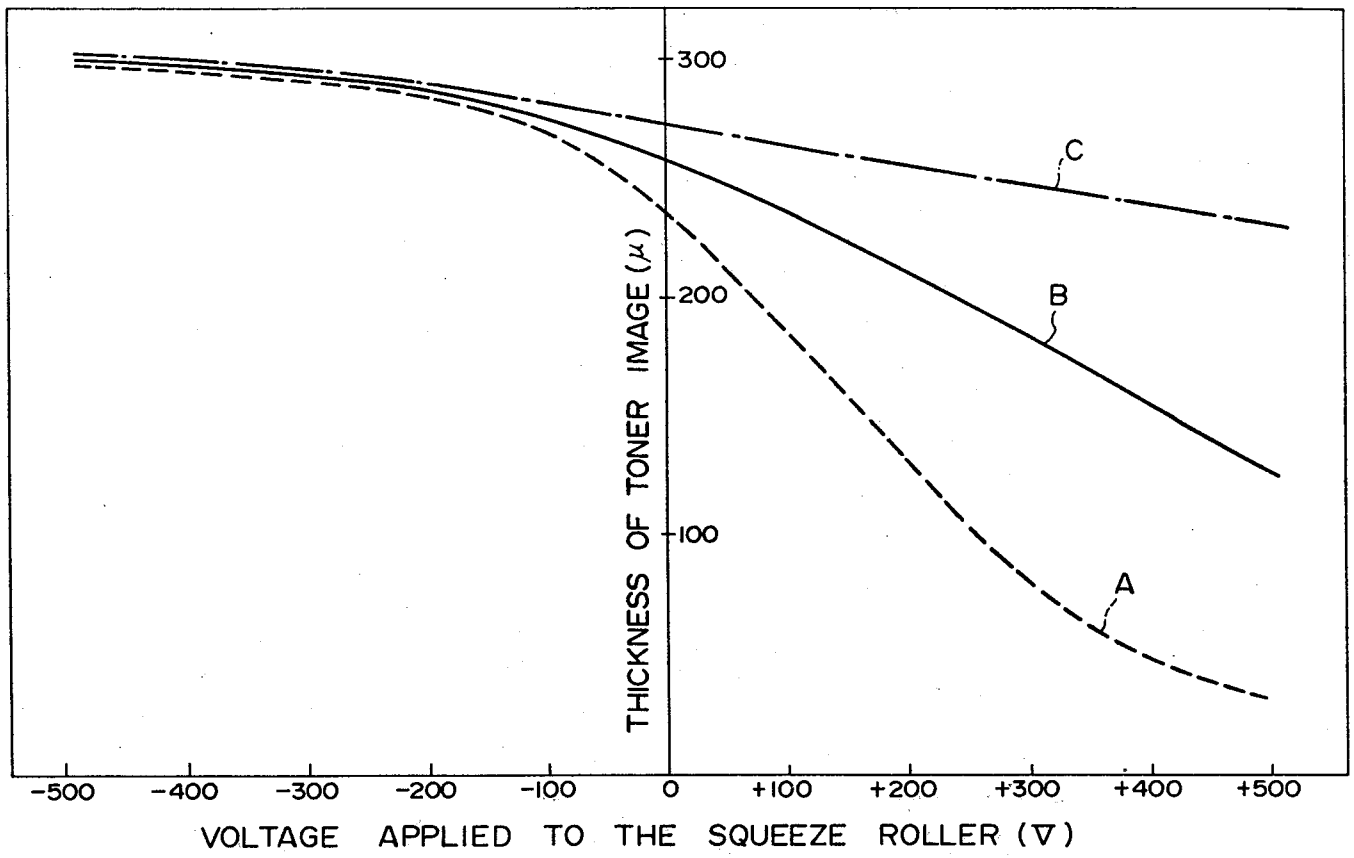
FIG. 3 is a graphical representation showing the relation between the thickness of the toner image and the level of the voltage applied to the squeeze roller used in this invention.

FIG. 3 shows the results of a test concerning the relation between the level of the voltage applied to the squeeze roller 18 and the image density of the toner image. The image density is represented by the thickness of the toner image in terms of microns. In the test, the space between the developing roller 13 and the electrostatic latent image carrying drum 16 was made equal to the space between the developing roller 13 and the main doctor blade 15*b*, and the space between the squeeze roller 18 and the developing roller 13 was set at different magnitudes all of which were larger than said space. The drum and the rollers were rotated at the peripheral speed of 45m/min. In FIG. 3, curve-A shows the relation when the space between the squeeze roller 18 and the surface of the toner layer was 50μ, curve-B shows the relation when 100μ and curve-C shows the relation when 300μ. This graph shows that the thickness of the toner image is reduced and the image density is lowered both as the space between the squeeze roller 18 and the developing roller 13 is reduced and as the level of the voltage applied to the squeeze roller 18 is increased. The toner was charged with negative polarity in the test.

However, if the level of the voltage applied to the squeeze roller 18 is too high, it is difficult to recover the toner sticking to the surface of the squeeze roller 18 by the suction nozzle 19. Therefore, the upper limit of the level of the voltage applied to the squeeze roller 18 is +500 V and the lower limit is −500 V, and the maximum space between the surface of the toner layer and the squeeze roller 18 which is equal to the difference between the levels of the edge of the main doctor blades 15*b* and the surface of the squeeze roller 18 is about 500μ.

We claim:

1. An apparatus for developing an electrostatic latent image in an electrostatic apparatus comprising a latent image carrying medium carrying thereon an electrostatic latent image, a developing roller which carries thereon a toner layer for developing the latent image into a toner image, a rotatable squeeze roller provided in the vicinity of said developing roller with the periphery of said squeeze roller extending in parallel to the periphery of said developing roller, and means for applying a voltage to said squeeze roller with respect to the developing roller, said voltage applying means being arranged to change the level of the voltage applied to the squeeze roller whereby the thickness of the toner layer is controlled by the level of the voltage applied to said squeeze roller, and means for reducing the thickness of said toner layer on said developing roller before the toner layer faces said squeeze roller to such a thickness that the surface of the toner layer is spaced from the surface of the squeeze roller.

2. An apparatus for developing an electrostatic latent image as claimed in claim 1 wherein said squeeze roller is movable to vary the space between the squeeze roller and the developing member.

3. An apparatus for developing an electrostatic latent image as claimed in claim 1 wherein said means for applying a voltage to the squeeze roller is capable of applying either a negative or a positive voltage to the squeeze roller.

* * * * *